United States Patent [19]

Manservigi et al.

[11] Patent Number: 4,962,772

[45] Date of Patent: Oct. 16, 1990

[54] FORMATION OF CIGARETTES INTO GROUPS

[75] Inventors: Alberto Manservigi; Antonio Gamberini, both of Bologna, Italy

[73] Assignee: G.D. Societa per Azioni, Bologna, Italy

[21] Appl. No.: 178,638

[22] Filed: Apr. 7, 1988

[30] Foreign Application Priority Data

Apr. 24, 1987 [IT] Italy ..... 3444 A/87

[51] Int. Cl.[5] ..... A24C 5/32; A24C 5/33

[52] U.S. Cl. ..... 131/282; 131/283; 53/150

[58] Field of Search ..... 131/282, 283; 221/176, 221/123; 53/151

[56] References Cited

U.S. PATENT DOCUMENTS

| | | | |
|---|---|---|---|
| 1,247,364 | 11/1917 | Bracy | 53/151 X |
| 1,993,619 | 3/1935 | Neff et al. | 53/151 X |
| 3,190,459 | 6/1965 | Kochalski et al. | 131/282 X |
| 3,403,493 | 10/1968 | Focke | 53/151 |
| 4,342,321 | 8/1982 | Zullo | 131/282 |
| 4,571,917 | 2/1986 | Wheless et al. | 53/151 X |
| 4,607,475 | 8/1986 | Manservisi | 53/148 X |

FOREIGN PATENT DOCUMENTS 2067982 8/1981 United Kingdom .

*Primary Examiner*—V. Millin
*Assistant Examiner*—D. F. Crosby
*Attorney, Agent, or Firm*—Cushman, Darby & Cushman

[57] ABSTRACT

An apparatus for the formation of cigarettes into groups each consisting in at least one layer of single cigarettes lying parallel with and side by side one another. The cigarettes exit from the bottom of a plurality of channels, arranged side by side and forming part of the outlet of an infeed hopper, and come to rest side by side on a shelf, forming one layer. Pushers provided on either side of the layer effect a sideways compaction of the cigarettes, and a suction-generating seat incorporated into the shelf retains one cigarette at the middle of the layer so as to disallow its moving sideways during operation of the pushers.

5 Claims, 1 Drawing Sheet

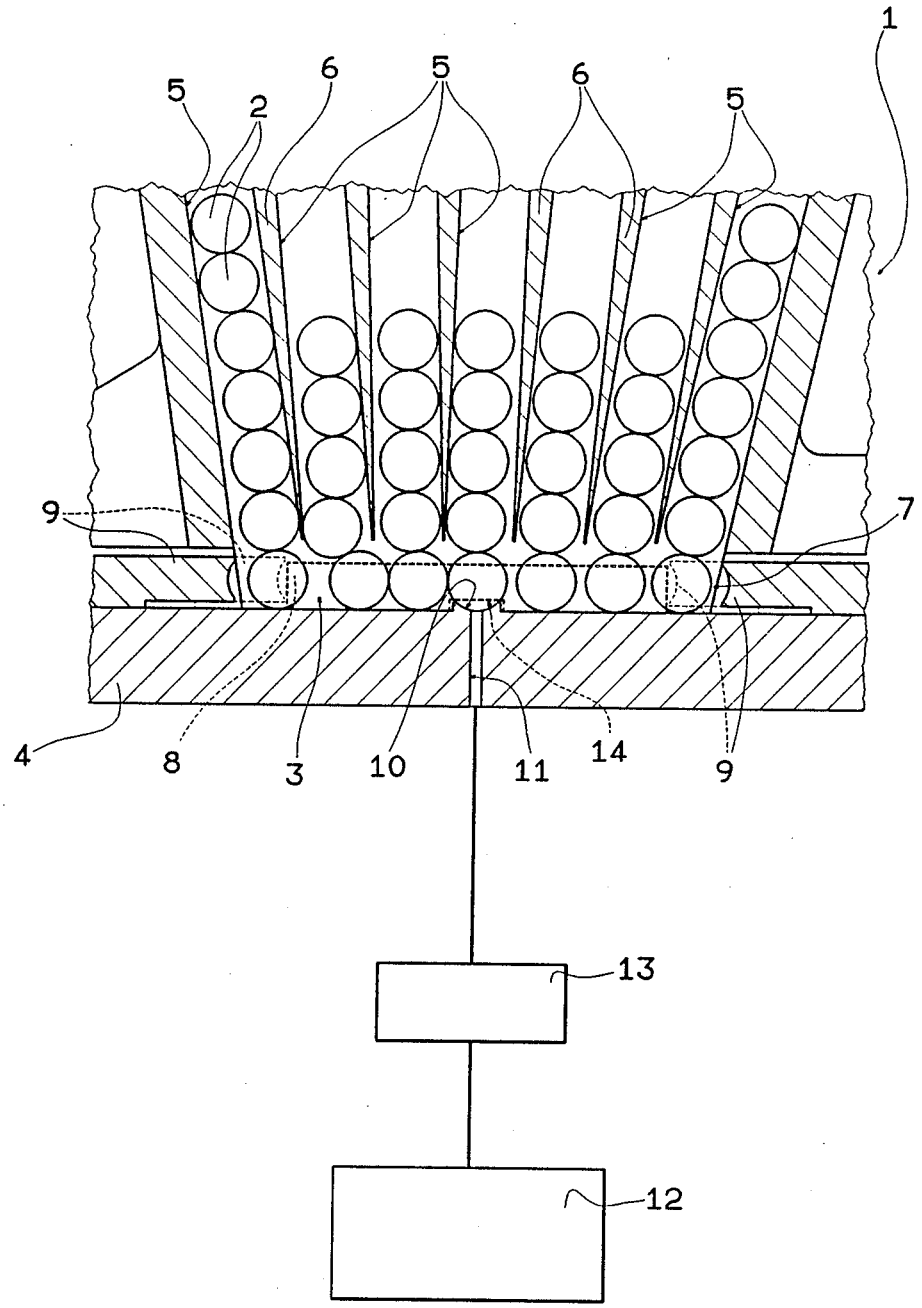
1
2
3
4
5
6
7
8
9
10
11
12
13
14

FORMATION OF CIGARETTES INTO GROUPS

BACKGROUND of the INVENTION

The present invention relates to an apparatus for the formation of cigarettes into groups.

The invention is applicable in particular to cigarette packaging machines, in which cigarettes to be wrapped are gathered into groups consisting of a given number of sandwiched layers formed from single cigarettes arranged side by side. Such groups will frequently each consist twenty cigarettes, arranged in three sandwiched layers, namely, two layers of seven cigarettes, and one layer of six.

In certain types of cigarette packaging machines, the three layers of each group are assembled singly at respective forming stations, before being sandwiched together.

In such packaging machines, each layer is formed by dispensing cigarettes to a forming station from a set of substantially vertical channels arranged side by side and provided in number equal to the number of cigarettes in the relative layer. The forming station consists essentially in a chamber, located beneath the dispensing ends of the channels, the bottom of which is embodied as a shelf capable of arresting the progress of the cigarettes that drop one by one from the channels. The single channels are established and separated one from the next by thin, substantially vertical walls, the bottom ends of which are distanced from the shelf so as to allow a clearance marginally greater than the diameter of the single cigarettes.

Given the thickness of the walls and the clearance allowed to the advancing cigarettes internally of the channels, the cigarettes making up the layers do not lie close together on the shelf. In order to supply the wrapping line with properly compacted groups of cigarettes, provision is made at either side of the forming station for pushing means that reciprocate horizontally and in opposition through a direction normal to the axes of the cigarettes; such means serve to compact each newly forming layer from either side closing the gaps between the individual cigarettes.

Nonetheless, it has been found that the action of such pushing means is not always sufficient to prevent the occurrence of drawbacks, in particular when the number of cigarettes in the layer is great, and the aggregate width of the gaps between single cigarettes making up the layer equals o exceeds the diameter of one cigarette.

It sometimes happens in such a situation that, before the pushing means have compacted the layer of cigarettes, the cigarettes themselves tend to drift on the shelf under the weight of the cigarettes in the channels above, to the point of leaving a space between two adjacent cigarettes wide enough to allow the descent, and at least part-insertion, of another cigarette; this can result both in the formation of a layer with one cigarette more than the prescribed number, and in damage to the part-inserted cigarette caused by the transfer indexer that pushes the layer toward a station at which the groups are formed.

The drawback described occurs especially often when the diameter of the cigarettes for packaging happens to be markedly small, as it is particularly easy in such an instance for an additional cigarette to occupy a gap, even a narrow gap, left between two adjacent cigarettes of the forming layer.

Accordingly, the object of the invention is that of setting forth an apparatus for the formation of cigarettes into groups, which will remain free of the drawbacks typical of conventional apparatus as mentioned above.

SUMMARY OF THE INVENTION

Cigarettes for packaging are formed into groups, each consisting of at least one layer of cigarettes disposed parallel with and arranged side by side one another, by an apparatus comprising an infeed hopper filled with cigarettes, at least one outlet through which cigarettes are dispensed from the bottom of the hopper, a plurality of substantially vertical walls dividing the outlet into a set of channels disposed side by side, a shelf positioned beneath the outlet and serving to support the layers of cigarettes dispensed from the channels, which is set apart from the bottom ends of the channels walls by a distance approximately equivalent to the diameter of one cigarette, an indexer serving to remove and transfer the layers from the shelf, and pushing means, located on either side of the layer, that effect a sideways compaction of the cigarettes.

The apparatus according to the invention also comprises retaining means which serve to hold at least one cigarette in contact with the shelf, substantially at the middle of the layer, in such a way that any sideways movement of the held cigarette is prevented.

BRIEF DESCRIPTION OF THE DRAWINGS

The invention will now be described in detail, by way of example, with the aid of the accompanying drawing, in which the sole FIGURE provides a sectional view of the apparatus disclosed.

DESCRIPTION OF THE PREFERRED EMBODIMENTS

With reference to the drawing, 1 denotes an infeed hopper, containing cigarettes 2, the bottom of which is provided with a outlet 3 designed to dispense the cigarettes onto a horizontal shelf 4.

The outlet 3 is divided up into seven channels 5 by six substantially vertical walls 6 set apart one from the other by a distance marginally greater than the diameter of one cigarette 2, their bottom edges distanced from the shelf 4 to create a clearance equal to or slightly exceeding this same diameter. Each channel 5 contains a plurality of cigarettes 2, disposed horizontally and stacked singly one on top of the next, and it will be observed that the bottom cigarettes 2 of the seven stacks occupy the shelf 4, forming a horizontal layer 7 of seven cigarettes 2 lying side by side that will ultimately be removed and directed toward a station (not illustrated) for their formation into groups (not illustrated); this removal step is effected by an indexer 8, capable of reciprocating movement on a level above that of the shelf 4 and in a direction parallel with the axes of the cigarettes 2.

9 denotes pushing means located on each side of the layer 7 of cigarettes, shown in two distinct operating positions by bold line and phantom line, respectively, which are operated by actuator means (not illustrated), and made to move horizontally in opposition to one another at right angles to the axes of the cigarettes 2. Such pushing means 9 serve to compact each layer 7 currently in formation by closing the gaps between the single cigarettes 2 and bringing them into contact one with the next.

According to the invention, the apparatus makes use of retaining mean offered by the shelf 4 and located beneath the middle channel 5; such means comprise a seat 10 that lies parallel to the cigarettes 2 and consists in a concave groove, occupying the entire dimension of the shelf 4 not visible in the drawing and disposed with its concave profile facing upward. More exactly, the concave surface of the groove lies tangential to the bearing surface of the shelf 4.

The shelf 4 incorporates a plurality of openings embodied as vertical bores 11 (one only of which is visible in the drawing), that pass through from side to side and enable the seat 10 to connect with a source of negative pressure 12; such a connection is effected by way of a control facility 13 consisting in a valve component that permits of enabling and inhibiting communication between the bores 11 and the negative pressure source 12 in cyclical mode, as will shortly become clear.

14 denotes a groove formed in the underside of the indexer 8, directly above the seat 10, which is disposed parallel with the axes of the cigarettes 2 and allows the indexer 8 to avoid contact with the seat when reciprocated across the shelf 4.

In operation each stroke of the indexer 8 that transfers a layer 7 to the aforementioned station (not illustrated) at which the layer of cigarettes are formed into groups (not illustrated) is followed by the dispensing of another layer 7 of cigarettes 2 from the bottom of the channels 5 onto the shelf 4 the cigarettes 2 of this new layer will be spaced apart one from the next, as explained at the outset. Immediately prior to the descent of the cigarettes, the bores 11 are connected to the negative pressure source 12 by the control facility 13, enabling the seat 10 to attract and retain the middle cigarette 2 of the layer 7 by suction.

The actuator means (not illustrated) will now operate the pushing means 9, which draw together to the point of reaching the position illustrated in phantom line, and compact the cigarettes 2 of the layer, urging them in from either side toward the cigarette 2 held in the seat 10.

Given that the held cigarette 2 cannot move to one side or to the other, it follows that sideways movement of the single cigarettes 2 of the layer 7 can no longer cause aggregation of the single gaps in the damaging fashioned a described in connection with the prior art; with the middle cigarette 2 held fast, only the three gaps between the cigarettes on the right or left hand side can now effectively be added up to form a space; in short, the cigarette 2 held in the seat 10 splits up the layer 7 into two parts, substantially halving the space that could otherwise be created between any two cigarettes 2.

Once the pushing means 9 have completed their compacting action, and before the layer 7 is removed from the shelf 4 by the indexer 8, the communication between bores 11 and negative pressure source 12 will be shut off by the control facility 13 in order to facilitate the slide of the layer 7 toward the station (not illustrated) at which the cigarettes 2 are formed into groups (not illustrated).

Needless to say, numerous modification might be made to the apparatus disclosed without straying from the scope of the invention, the principle of which remains intact.

For example, the control facility 13 can equally well be omitted from the apparatus in a variation (not illustrated) of the embodiment shown in the drawings, as even with suction generated permanently through the bores 11, the cigarette 2 held in the seat 10 will not suffer damage attributable to the action of the indexer 8.

Moreover, in another variation (not illustrated) of the embodiment disclosed, the seat 10 might be non-suction-generating, in which case the bores 11, the negative pressure source 12 and the control facility 13 could be eliminated. In this instance, sideways movement of the cigarette 2 accommodated by the seat 10 will be disallowed simply by the cradled shape of the seat itself.

Again, the shelf 4 might incorporate a plurality of suction-generating seats 10, for example two, located one alongside the other and positioned at intermediate points along the shelf 4, which will disallow sideways movement of two cigarettes 2 at the middle of each layer 7 dispensed.

What is claimed:

1. Apparatus for organizing cigarettes into groups, each consisting of at least one horizontal layer of cigarettes in which, in said layer, all of the cigarettes have a given diameter and are arranged side by side with their longitudinal axes parallel to one another, said apparatus comprising:

in infeed hopper including a plurality of laterally spaced generally vertical walls having respective lower ends, and a horizontal shelf having an upper surface disposed directly under said lower ends of said vertical walls, with vertical spacing between said ends and said surface approximating said given diameter of each cigarette thereby defining a space suitable to be occupied by one horizontal layer of cigarettes; each respective neighboring two of said vertical walls defining between them a respective downwardly open channel suitable to be occupied by a respective generally vertical column of generally horizontal cigarettes in which all of the cigarettes have said given diameter and are arranged side by side with their longitudinal axes parallel to one another, so that when said horizontal layer of cigarettes is present in said space, said columns of cigarettes are supported on respective cigarettes in said layer;

each said generally vertical wall, if disposed between two of said channels, having a thickness transversally of said infeed hopper at said lower end of such generally vertical wall, which is less than said given diameter, so that said cigarettes of said columns, as successively deposited in respective said layers on said surface on said shelf, are initially spaced apart by distances which are each less than said given diameter;

a pushing means juxtaposed with said space and arranged to simultaneously act, in use, upon opposite laterally outermost ones of said cigarettes in said layer in said space for pushing said laterally outermost cigarettes sideways towards one another thereby diminishing all of said distances by which said cigarettes in said layer in said space are initially spaced apart and correspondingly horizontally condensing said layer in width in said space;

retaining means associated with said shelf and adapted to act, in use, on a single cigarette in said layer to hold a non-laterally outermost cigarette in said layer in said space sufficiently securely against said shelf as said pushing means is being operated in use to condense said layer in width, as to prevent said non-laterally outermost cigarette from being moved sideways as said layer is being condensed in width;

an indexing means juxtaposed with said space and arranged to simultaneously act, in use, upon respective one ends of said cigarettes in said horizontal layer in said space, after operation of said pushing means to condense said layer in width for transferring said layer horizontally in a direction parallel to the longitudinal axes of said cigarettes in said horizontal layer throughout such a distance that said layer is no longer disposed directly under said lower ends of said vertical walls and a successive layer can form on said surface of said shelf by downward movement of said cigarettes in said columns.

2. The apparatus of claim 1, wherein:

two of said generally vertical walls define a substantially centrally located one of said channels; and said retaining means comprises an upwardly concave seat provided on said shelf and extending directly under said substantially centrally located one of said channels for cradling therein a cigarette which is substantially centrally located in said layer in said space.

3. The apparatus of claim 2, wherein:

said concave seat has an upwardly presented surface thereof provided with at least one suction opening therethrough for holding a cradled cigarette thereagainst by vacuum; and means for communicating said at least one suction opening to a source of negative fluid pressure.

4. The apparatus of claim 3, wherein:

said means for communicating said at least one suctio opening to a source of negative fluid pressure includes a control means for cyclically cutting-off and re-establishing comminication of negative fluid pressure to said at least one suction opening, for cutting-off operation of said retaining means except when useful in connection with operation of said pushing means to prevent sideways movement of said substantially centrally located cigarette as said layer is being condensed in width.

5. The apparatus of claim 2, wherein:

said indexing means includes a downwardly opening groove arranged for avoiding clashing of said indexing means with said retaining means as said indexing means transfers said layer of cigarettes from said space.

* * * * *